US006105559A

United States Patent [19]

Stoltman

[11] Patent Number: 6,105,559

[45] Date of Patent: Aug. 22, 2000

[54] CHARGE PROPORTIONING VALVE ASSEMBLY

[75] Inventor: Donald Dibble Stoltman, Henrietta, N.Y.

[73] Assignee: General Motors Corporation, Detroit, Mich.

[21] Appl. No.: 09/195,115

[22] Filed: Nov. 18, 1998

[51] Int. Cl.[7] ..... F02M 25/07

[52] U.S. Cl. ..... 123/568.19

[58] Field of Search ..... 123/568.19, 568.2

[56] References Cited

U.S. PATENT DOCUMENTS

| | | | |
|---|---|---|---|
| 3,882,837 | 5/1975 | Horie et al. | 123/568.19 |
| 3,954,091 | 5/1976 | Stumpp | 123/568.19 |
| 4,005,692 | 2/1977 | Nohira et al. | 123/568.19 |
| 4,149,503 | 4/1979 | Tadashi et al. | 123/568.19 |
| 4,366,799 | 1/1983 | Suda | 123/568.19 |
| 4,924,840 | 5/1990 | Wade | 123/568.19 |
| 5,056,309 | 10/1991 | Linder et al. | 123/568.19 |

FOREIGN PATENT DOCUMENTS

| | | |
|---|---|---|
| 00363021A | 4/1990 | European Pat. Off. . |
| 3237337A | 4/1983 | Germany . |
| 2313208A | 11/1997 | United Kingdom . |

*Primary Examiner*—Willis R. Wolfe
*Attorney, Agent, or Firm*—John A. VanOphem

[57] ABSTRACT

An internal combustion engine includes a valve body having an intake air port and an EGR port. The engine also has an intake passage for transporting an intake air/EGR mixture from the valve body to an engine combustion chamber and an exhaust passage to exhaust gases from the combustion chamber. An EGR passage extends between the exhaust passage and the intake passage for transporting recirculated exhaust gases to the EGR port of the valve body. An intake air passage transports intake air to the intake air port of the valve body and to the intake passage. A valve assembly includes a rotatable shaft supported in the valve body extending across the intake air port and the EGR port. An EGR throttle plate is supported on the shaft and is operable to close the EGR port, and an air throttle plate is supported on the shaft and is operable to partially restrict the intake air port. The shaft rotates the EGR throttle plate and the air throttle plate to regulate flow through the intake air port and the EGR port to vary the proportion of recirculated exhaust gases delivered to the intake passage.

4 Claims, 1 Drawing Sheet

CHARGE PROPORTIONING VALVE ASSEMBLY

TECHNICAL FIELD

This invention relates to an intake system to vary the proportion of recirculated exhaust gases delivered to an internal combustion engine.

BACKGROUND OF THE INVENTION

In an internal combustion engine where action by the intake valves is used to throttle the engine as opposed to action by a throttle valve, a new strategy for controlling nitrous oxide (NOx) emissions is required. In an engine throttled by a throttle valve, a vacuum condition is established in the intake manifold at low operating speeds due to the pressure drop across the throttle valve while the engine continues to draw from the intake manifold. This pressure drop across the throttle valve may be used to draw recirculated exhaust gases back through the intake manifold and into the engine for recombustion. By contrast, in an engine where the throttling function is performed by the intake valves, there is an insignificant pressure drop between the exhaust and intake manifolds which necessitates a relatively large flow area therebetween in order to recirculate sufficient exhaust gases to the intake and ultimately reduce NOx emissions.

SUMMARY OF THE INVENTION

This invention provides a strategy for reducing NOx emissions and improving fuel economy in a conventionally throttle-less internal combustion engine, such as with variable valve train, direct injection gasoline, and diesel engines. A singularly controlled, dual valve provides the adequate flow area required to recirculate exhaust gases in an intake system with minimal pressure drop and proportions the quantity of intake air and exhaust gases supplied to the intake system. An EGR port and an intake air port are adjacent to each other and open into a single intake passage to the intake side of the engine. A single rotatable shaft extends across the two ports and supports an EGR throttle plate which is sized to close the EGR port and an air throttle plate which is sized to restrict a portion of the intake air port. The throttle plates are positioned approximately perpendicular with respect to each other such that when only intake air is required, an actuator rotates the shaft until the EGR throttle plate closes the EGR port and the air throttle plate provides minimal restriction to the intake air port. When exhaust gas recirculation is required, the shaft rotates thereby opening the EGR port and restricting the intake air port. The sizing of the ports and plates determines the maximum exhaust gas dilution of the air mixture. In addition, sufficient flow area is accommodated to provide adequate exhaust flow for recirculating exhaust gases to the combustion chamber to compensate for the minimal pressure drop across the valves.

DESCRIPTION OF THE PREFERRED EMBODIMENT

Figure 1:
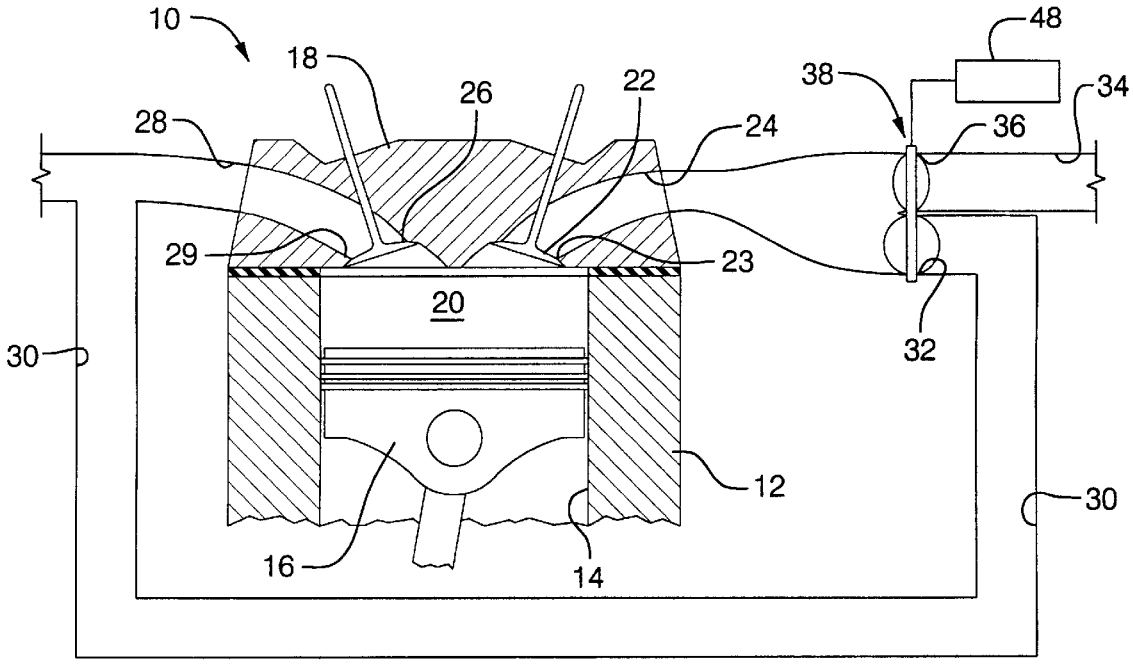
FIG. 1 is a schematic view of an internal combustion engine embodying features of the present invention.

FIG. 1 illustrates an internal combustion engine shown generally as 10 having a cylinder block 12 with a plurality of engine cylinders 14. An engine piston 16 is disposed within each cylinder 14 for reciprocal movement. The cylinders 14 are closed by a cylinder head 18, where the piston 16 and the cylinder head 18 cooperate to define a combustion chamber 20 therebetween.

Each cylinder 14 has an intake valve 22 seated in a combustion chamber inlet 23 located where an intake passage 24 adjoins the combustion chamber 20. In an intake valve throttled engine, the intake valve 22 is variable and is operable to throttle the intake air/EGR mixture supplied from the intake passage 24 and delivered to the combustion chamber 20, by varying the lift and duration of the valve stroke.

Each cylinder 14 also has an exhaust valve 26, to exhaust the combustion gases through an exhaust passage 28. The exhaust valve 26 is seated in a combustion chamber outlet 29 where the exhaust passage adjoins the cylinder 14. An EGR passage 30 extends from the exhaust passage 28 and opens through an EGR port 32 to the intake passage 24 for recirculating exhaust gas back through the engine for recombustion. Since there is minimal pressure drop between EGR passage 30 and the intake passage 24 to draw EGR, the EGR passage 30 must be of sufficient cross section to facilitate adequate EGR flow therethrough.

An intake air passage 34 transports intake air to the intake passage 24 through an intake air port 36, adjacent to the EGR port 32.

Figure 2:
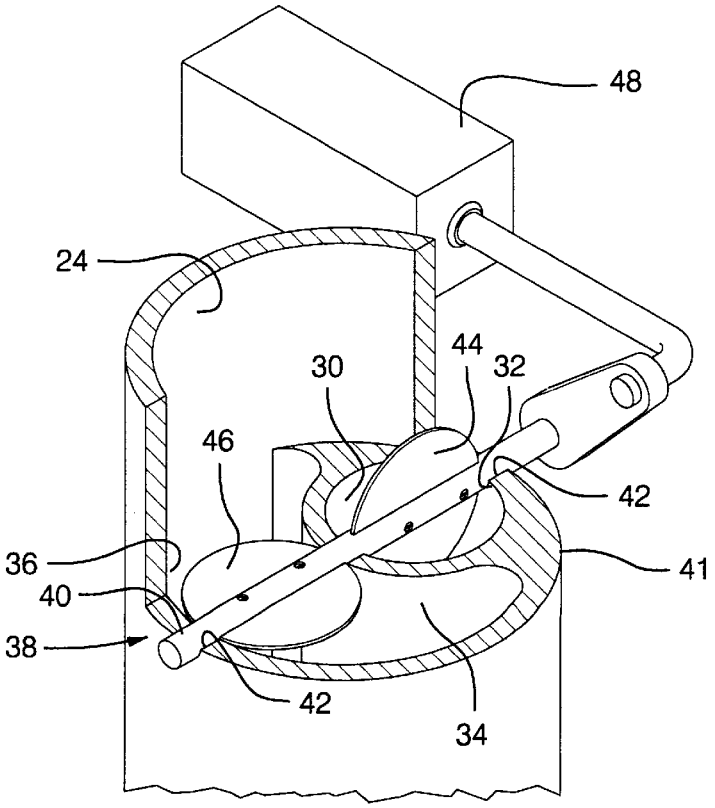
FIG. 2 is an enlarged isometric view, partially in section, of the present invention.

A charge proportioning valve assembly 38, shown in FIG. 2, includes a shaft 40 which extends transversely across a valve body 41 which houses the intake air port 36 and the EGR port 32 and is journaled in openings 42 in the valve body. The valve assembly 38 further includes an EGR throttle plate 44 supported on the shaft 40 and operable to close the EGR port 32 and an air throttle plate 46 supported on the shaft and operable to partially restrict the intake air port 36. The plates 44,46 are oriented with an angular offset, preferably close to perpendicular, with respect to each other such that when one plate operates to reduce flow therethrough, the other plate operates to increase flow. The shaft 40 and affixed plates 44,46 are rotated by an actuator 48.

The charge proportioning valve assembly 38 operates to vary the proportion of exhaust gas in the intake air/EGR mixture delivered to the engine. When only intake air is required, the actuator 48 rotates the shaft 40 until the EGR throttle plate 44 closes the EGR port 32 and the air throttle plate 46 provides minimal restriction of the intake air port 36. When EGR is demanded, the shaft 40 rotates to open the EGR port 32 and to restrict a portion of the intake air port 36 to provide the desired exhaust gas dilution while maintaining the total air flow. The sizing of the ports 32,36 and the throttle plates 44,46 determines the maximum exhaust gas percentage obtainable in the intake air/EGR mixture.

The charge proportioning valve assembly has application in several engine classes where conventional throttle valves are not used to adjust engine load. For example, a diesel engine that varies power by adjusting the amount of fuel delivered, a direct injection gasoline engine that adjusts the air-to-fuel ratio, and variable intake valve engine that controls air flow through the intake valves.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A valve assembly for varying recirculated exhaust gases delivered to an internal combustion engine comprising a valve body having an intake air port and an EGR port, a rotatable shaft extending transversely across said intake air port and said EGR port, an EGR throttle plate supported on said shaft and operable to close said EGR port, an air throttle plate supported on said shaft and dimensioned to partially restrict flow through said intake air port in a closed position, wherein said shaft is operable to rotate said EGR throttle plate and said air throttle plate to regulate flow through said intake air port and said EGR port to vary the proportion of recirculated exhaust gases delivered to the engine.

2. An internal combustion engine comprising a valve body having an intake air port and an EGR port, an intake passage for transporting an intake air/EGR mixture from said valve body to an engine combustion chamber, an exhaust passage operable to exhaust gases from the combustion chamber, an EGR passage extending between said exhaust passage and said intake passage for transporting recirculated exhaust gases to said EGR port of said valve body, an intake air passage for transporting intake air to said intake air port of said valve body to said intake passage, a valve assembly including a rotatable shaft supported in said valve body extending across said intake air port and said EGR port, an EGR throttle plate supported on said shaft and operable to close said EGR port, and an air throttle plate supported on said shaft and dimensioned to partially restrict flow through said intake air port in a closed position, wherein said shaft is operable to rotate said EGR throttle plate and said air throttle plate to regulate flow through said intake air port and said EGR port to vary the proportion of recirculated exhaust gases deliver to said intake passage.

3. An intake valve throttle internal combustion engine comprising a valve body having an intake air port and an EGR port, an intake passage for transporting an intake air/EGR mixture from said valve body to an engine combustion chamber, having an intake valve operable to throttle the quantity of the intake air/EGR mixture delivered to the combustion chamber through said intake passage, an exhaust passage having an exhaust valve operable to open to release exhaust gases from the combustion chamber into said exhaust passage, an EGR passage extending between said exhaust passage and said intake passage for transporting recirculated exhaust gases to said EGR port of said valve body, an intake air passage for transporting intake air to said intake air port of said valve body to said intake passage, a rotatable shaft supported in said valve body extending across said intake air port and said EGR port, an EGR throttle plate supported on said shaft and operable to close said EGR port, an air throttle plate supported on said shaft and dimensioned to partially restrict flow through said intake air port in a closed position, and an actuator operable to rotate said shaft to regulate flow through said intake air port and said EGR port to vary the proportion of recirculated exhaust gases and intake air delivered to said intake passage.

4. An intake valve throttled internal combustion engine, as defined in claim 3, wherein said EGR throttle plate and said air throttle plate are oriented with an angular offset with respect to each other.

* * * * *